US005884638A

United States Patent [19]

Ohba

[11] Patent Number: 5,884,638

[45] Date of Patent: Mar. 23, 1999

[54] CARTRIDGE TYPE FEEDING CONTAINER FOR COSMETICS STICK

[75] Inventor: Atsushi Ohba, Tokyo, Japan

[73] Assignee: Suzono Kasei Kabushiki-kaisha, Tokyo, Japan

[21] Appl. No.: 97,548

[22] Filed: Jun. 15, 1998

[30] Foreign Application Priority Data

Jul. 1, 1997 [JP] Japan ..... 9-193319

[51] Int. Cl.[6] ..... A45D 40/24

[52] U.S. Cl. ..... 132/318; 132/294; 401/75

[58] Field of Search ..... 132/293, 294, 132/314, 317, 318; 206/229, 581, 210, 385, 823; 401/98, 99, 88, 62, 70, 76, 75, 79

[56] References Cited

U.S. PATENT DOCUMENTS

| | | |
|---|---|---|
| 885,190 | 4/1908 | Smith . |
| 1,637,545 | 2/1927 | Bosworth . |
| 2,460,323 | 2/1949 | Wehn . |
| 2,491,723 | 12/1949 | Gelardin . |
| 3,002,517 | 10/1961 | Pitton . |
| 3,106,908 | 10/1963 | Gretz . |
| 3,197,024 | 7/1965 | Bau . |
| 4,544,296 | 10/1985 | Jarvis et al. . |
| 4,702,634 | 10/1987 | Herold et al. . |
| 4,882,874 | 11/1989 | Paulson et al. . |
| 4,997,299 | 3/1991 | Ohba . |
| 5,423,623 | 6/1995 | Bakic . |
| 5,609,430 | 3/1997 | Mazzola et al. . |

FOREIGN PATENT DOCUMENTS

| | | |
|---|---|---|
| 1196278 | 11/1959 | France . |
| 3211065 A1 | 11/1982 | Germany . |
| 4340067 A1 | 5/1994 | Germany . |
| 56-14726 | 4/1981 | Japan . |
| 56-37448 | 9/1981 | Japan . |
| 56-39455 | 9/1981 | Japan . |
| 57-137198 | 8/1982 | Japan . |
| 57-44551 | 9/1982 | Japan . |
| 58-10502 | 2/1983 | Japan . |
| 58-9535 | 2/1983 | Japan . |
| 2-38669 | 10/1990 | Japan . |
| 3-50814 | 10/1991 | Japan . |
| 5-68413 | 9/1993 | Japan . |
| 4567 | of 1887 | United Kingdom . |

*Primary Examiner*—Gene Mancene
*Assistant Examiner*—Pedro Philogene
*Attorney, Agent, or Firm*—Frishauf, Holtz, Goodman, Langer & Chick

[57] ABSTRACT

A cartridge type feeding container for a cosmetics stick has a structure such that the diameter can be easily reduced, the product can be easily assembled, and the number of parts employed therein can be reduced. A cartridge (5) in the main body (1) has a push spring (17) which urges a chuck (13) toward a retracting direction. The push spring (17) is mounted between the rear end of a bar (15) of the chuck (13) and a partition member (47) of a cartridge cylinder (11). On the cartridge cylinder (11) and on a push rod (23) are provided synchronously engageable sections (59 and 71) which are engageable with each other to render the cartridge cylinder (11) and the push rod (23) non-rotatable relative to each other.

11 Claims, 5 Drawing Sheets

CARTRIDGE TYPE FEEDING CONTAINER FOR COSMETICS STICK

BACKGROUND OF THE INVENTION

This invention relates to a cartridge type feeding container for a cosmetics stick, and more particularly, to a container which can be smaller in diameter, which can be easily assembled, and wherein the number of parts employed therein can be reduced.

DESCRIPTION OF THE PRIOR ART

There are two types of container cartridges having an automatic-return spring therein for a cosmetics stick: a push spring type and a pull spring type. The push spring type has mostly been in use. Atypical example of push-spring-type cartridges is disclosed in Japanese Utility Model Publication Sho. 56-39455 or Hei. 3-50814. It has a coil spring housed on the outer circumference of a cosmetics stick, and this coil spring pushes a core chuck toward the retracting direction. This construction enables an easy assembling of the spring by only inserting a coil spring between the cartridge and the chuck, without a specific spring engagement means. However, this construction requires an extra protection member disposed between the stick and the spring to protect the cosmetic material from damage by touching the coil spring housed around the circumference of the cosmetic material. In other words, around the outer circumference of the cosmetic material are mounted two parts, said protection member and a coil spring, other than the cartridge cylinder. Accordingly, this leads to a shortcoming such that the diameter of the cartridge and, further, the diameter of the container may become far greater than that of a cosmetics stick.

Cosmetics containers basically require good designing with a light and slender appearance, so it is a disadvantage to use a container whose diameter may be larger.

A pull-spring-type cartridge, on the other hand, has been long known. Practical structures are disclosed in Japanese Utility Model Publication Sho. 56-37448 and Sho. 58-9535. The pull spring type cartridge, however, has the following disadvantages.

1. It requires labor in assembling and high cost since it is necessary to provide an engagement mechanism between the front of the spring with the chuck and between the rear end of the spring and the cartridge (or plug).

2. It is required to take a measure such as making a spring shape with different diameters (terraced) for the spring engagement. As a result, the spring becomes expensive.

3. It sometimes does not provide consistent resilience for a container with a longer stroke or a heavy cosmetics material, since a pull spring has less consistent resilience than that of a push spring.

Another push-spring-type cartridge is disclosed in Japanese Utility Model Publication Sho. 58-10502, in which a spring is not mounted on the outer circumference of a cosmetics stick. In this construction, an elongated bar is extended at the tail of the chuck, a partition section is formed inside the cartridge cylinder, and a push spring is housed between the engagement piece at the tail of the bar and the partition section.

The whole construction of the container disclosed in Japanese Utility Model Publication Sho. 58-10502 is, however, complicated, since the container has a holding portion formed in the main body. Said holding portion and the base of the main body are made rotatable relative to each other so that the rod can be fed in and out. The container disclosed in Japanese Utility Model Publication Sho. 58-10502 does not have flexibility and is substantially different from that of the present invention, which provides containers with flexible shapes (to be described later).

Containers with a rotation-stop mechanism mounted in the cartridge are disclosed in (1) Japanese Laid-open Patent Publication Sho. 57-137198, (2) Japanese Utility Model Publication Hei. 2-38669, and (3) Japanese Laid-open Utility Model Publication Hei. 5-68413. (1) and (2) are provided with a rotation-stop mechanism by inserting a plug, as another member, into a cartridge. The end cap also serves as a core chuck drop-off stopper. (3) has a rotation-stop mechanism by arranging a slit shaft around the cosmetic material and making the rear end of the shaft non-rotatable.

SUMMARY OF THE INVENTION

An object of the invention is to provide a cartridge type feeding container for a cosmetics stick which can be formed with a reduced diameter, can be easily assembled, and can be constructed with the minimum number of parts employed therein.

Another object of the invention is to provide a cartridge type feeding container for a cosmetics stick, which is substantially applicable to all diameters of cosmetics sticks, wherein a rotation-stop mechanism of the push rod is mounted in the cartridge, such that the rotation-stop mechanism can be provided either in the bore of the cartridge or on the inner or outer circumference of the rear end of the elongated bar from the core chuck.

According to a feature of the present invention, a cartridge type feeding container for a cosmetics stick comprises a main body having a push rod which can be advanced and retracted in an axial direction, and a cartridge which is mounted detachably at the tip of said main body, and having a cosmetics stick therein which is movable in an axial direction. A spiral engagement mechanism is arranged between said push rod and said main body. Said cartridge has a chuck which holds the tail end of a cosmetics stick and is fed out by said push rod, a cartridge cylinder which has a bore wherein said chuck is slidably movable, and a push spring which urges the chuck toward the retracting direction. Said chuck has a holding portion which supports the tail end of a cosmetics stick, and an elongated bar which extends toward the bottom direction from said holding portion. Said cartridge cylinder has a partition section which has a through hole wherein said bar is inserted. Said push spring is installed between the bottom of said bar and said partition. A synchronous engagement section is provided between said cartridge cylinder and said push rod which become engageable with each other when the cartridge is inserted in the main body, so that the push rod can be advanced and retracted by rotating the cartridge and main body relative to each other.

BRIEF DESCRIPTION OF THE DRAWING

FIGS. 1A–1D show views of the inner construction of a cartridge type feeding container for a cosmetics stick according to one embodiment of the present invention, wherein FIG. 1A shows a cross-sectional side view of the whole container; FIG. 1B is a cross-sectional side view of the cartridge taken along line 1B—1B in FIG. 1A; FIG. 1C is a cross-sectional view of the cartridge taken along line 1C—1C in FIG. 1A; and FIG. 1D is a front view of the bend piece.

FIGS. 4A and 4B show cross-sectional side views of the inner structure of the cartridge type feeding container for a cosmetics stick according to another embodiment of the present invention, wherein FIG. 4A shows a cross-sectional side view of the whole container and FIG. 4B shows a side view of an assemblage of the chuck, partition member and push spring.

FIGS. 5A and 5B show views of the construction of a cartridge of the cartridge type feeding container for a cosmetics stick according to still another embodiment of the present invention, wherein FIG. 5A shows a cross-sectional view of the whole cartridge, and FIG. 5B shows a view of an assembled unit of the built-in parts.

DETAILED DESCRIPTION OF THE PREFERRED EMBODIMENTS

Figure 1A:
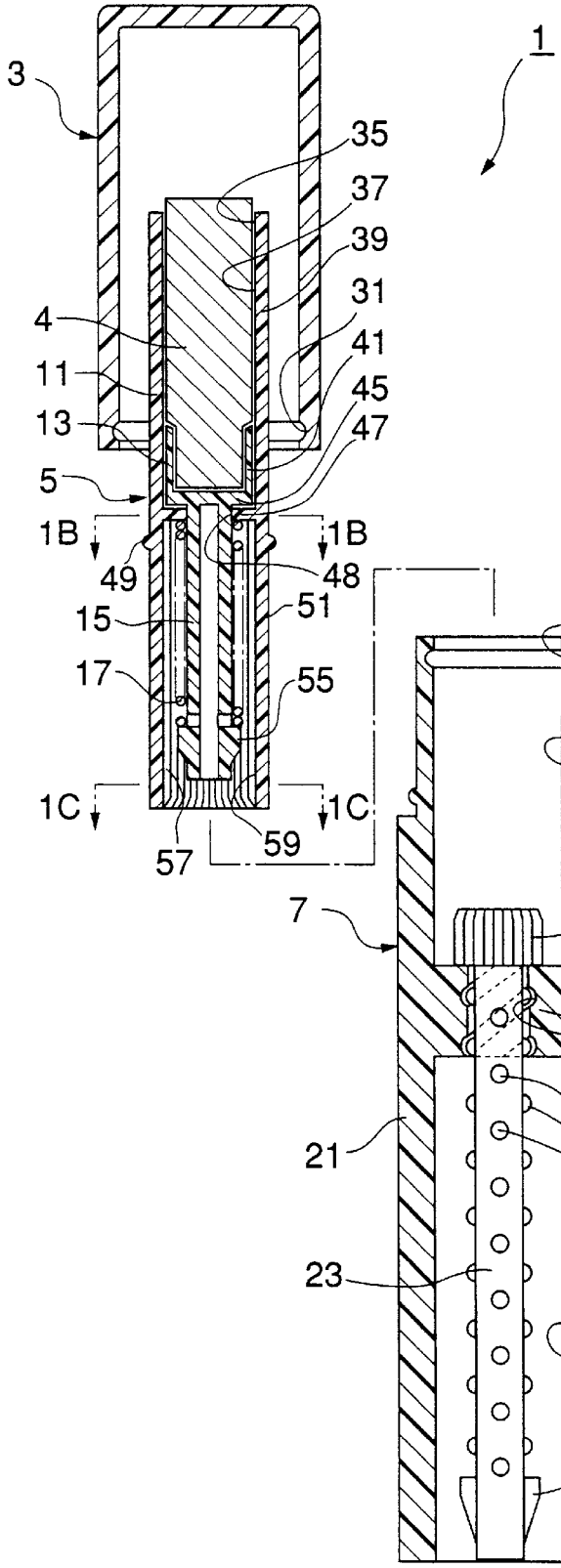
Figure 1B:
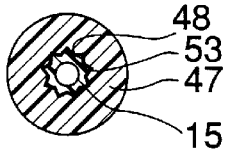
Figure 1C:
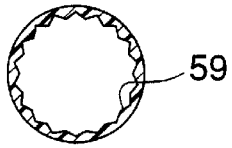
Figure 1D:
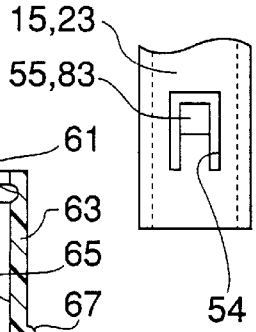
Figure 1D:
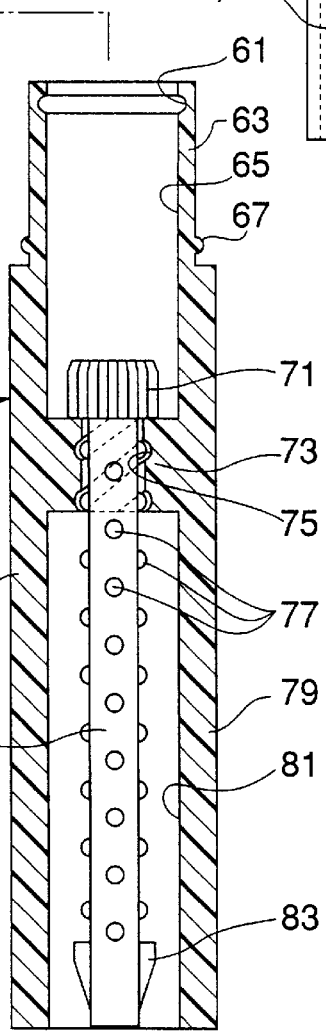

FIGS. 1A–1D show the inner structure of the cartridge type feeding container for a cosmetics stick according to one embodiment of the invention, FIG. 1A shows a cross-sectional view of the whole container; FIG. 1B shows a sectional view of the cartridge taken along line 1B—1B in FIG. 1A; FIG. 1C shows a sectional view of the cartridge taken along line 1C—1C in FIG. 1A; and FIG. 1D shows a front view of the chuck bend piece.

The cartridge type feeding container 1 for a cosmetics stick, employed for a little larger diametered eye colors or lipsticks, comprises a cap 3, a cartridge 5, and a main body 7. The cartridge 5 comprises three main parts such as a cartridge cylinder 11, a chuck 13 (coupled to a bar 15), and a push spring 17. The main body 7 comprises two main parts such as a main cylinder 21 and a push rod 23.

The cap 3 has a capped cylindrical shape, covering the upper outer circumference of the cartridge 5, and is provided with an annular recess 31 at the lower portion of the inner surface thereof. The inner surface of the tail (lower portion of cap 3 as seen in FIG. 1A) of the cap 3 is maintained as being fitted in a cap connecting portion 63 of the front or top end of the main cylinder 21, when the cap is attached to the main cylinder 21.

Projections 67 on the outer surface of the connecting portion 63 fit in the annular recess 31 so that the cap 3 is retained on the connecting portion 63 of the main cylinder 21. In a case of a small diametered eye-brow pencil container, such a cap 3 is unnecessary.

The cartridge cylinder 11 has a cylindrical shape with an open top and tail, and a partition 47 is protrudely formed at a middle portion of the inner surface thereof. The inner surface of a front portion 39, located above the partition 47, serves as a bore 37 in which the cosmetics stick 4 and the chuck 13 are slidably movable. From the top opening 35 of the bore 37, the cosmetics stick 4 is advanced and retracted. This example shows that all portions, the upper and lower portions, of the bore 37, including the top opening 35, have the same inside diameter.

A push spring 17 and a bar 15 are housed in the bore 57 of the rear or lower portion 51 of the cartridge cylinder 11, under the partition 47. The bore 57 has a plurality of synchronously engageable vertical ribs 59 extendedly formed in the axial direction (refer to FIG. 1C). Projecting ridges 49 are formed on middle portions of the outer surface of the cartridge cylinder 11, and are dimensioned to fit in an annular recess 61 of the inner surface at the top of the main cylinder 21 so that the cartridge 5 will be rotatably engaged with the main cylinder 21, when the cartridge 5 is attached to the main cylinder 21.

The center of the partition 47 is provided with a through hole 48 (see FIG. 1B) in which the chuck bar 15 is inserted. Said through hole 48 and said chuck bar 15 have engageable vertical ribs and vertical grooves, as shown in FIG. 1B, so that the partition 47 and the chuck bar 15 (and also chuck 13) are not rotatable relative to each other. By virtue of this mechanism, the chuck 13 and the cosmetics stick 4 held by the chuck will be linearly advanced and retracted relative to the cartridge cylinder 11. Thus the cosmetics stick 4 will not be twisted when it is advanced or retracted with respect to the cartridge cylinder 11. The arrangement shown in FIG. 1B is not an essential subject of the invention; however, this arrangement can prevent a cosmetics stick 4 whose cross-section is round from rotating by friction between the cosmetic material and the surface area to which the cosmetic material is applied, while the cosmetics stick is in use. Further, in a round cosmetics stick which is truncated diagonally at the top end of the cosmetics stick 4, the effect of this method is significant. In such a container where the cosmetics stick 4 has an noval shape or an angulately-sectioned shape, the arrangement shown in FIG. 1B is not necessary to be used, because the shape of the chuck in the container will naturally provide the chuck with a rotation-stop mechanism. The bottom 45 of the chuck 13 is so arranged relative to the upper surface of the partition 47 to define the retracting extremity of the chuck 13 (i.e., the partition 47 serves as a lower stop for the chuck 13). To the lower surface of the partition 47 is abutted the upper surface of the push spring 17.

The holding portion 41 of the chuck 13 has a cavity, which opens upward at the upper portion of the chuck and holds the tail (lower end) of the cosmetics stick 4. The shape of the holding portion 41 is not limited to only the mentioned shape, but may be a shape of pinching a cosmetic material or a fork-like shape of sticking in a piercing the tail (or lower end) of a cosmetic material.

The chuck bar 15 is formed on and extends from the bottom 45 of the holding portion 41 of the chuck 13, and is elongated such that it extends toward the tail (lower end) of the cartridge 5. Said bar 15 has an outer diameter which is a little smaller than the inside diameter of the push spring 17 and has the above-mentioned vertical ribs 53 (see FIG. 1B) on the outer surface thereof.

A bend piece 55, which is formed on the tail (lower end) of the bar 15, having a thin-pipe-like shape, is provided, as shown in FIG. 1D, in a protruded portion surrounded by slits 54 which are formed on the right and left sides of and above said protruded portion through the wall of the bar. Said bend piece 55 will bend inwardly from the lower part thereof when forced inwardly toward the axis of the bar 15. When the load (force) is released, said bend piece 55 will spring back outwardly to its normal position by its own resilience. The bend piece 55 is protruded outwardly at its upper surface with right angles against the outer surface of the bar 15, and its lower surface is slanted. This bend piece 55 will inwardly bend twice during assemblage of the container; that is, when the bar 15 passes through the through hole of the partition 47 so that the chuck 13 is assembled inside the cartridge cylinder 11, and when the push spring 17 is mounted around the outer surface of the bar 15. Except for these times, the bend piece 55 protrudes outwardly and its upper surface pushes against the lower end of the push spring 17.

When the bar 15 is advanced by the push rod so that the spring 17 becomes most compressed (to its shortest length), the bend piece 55 will push against the partition 47 with the push spring 17 therebetween, and the limitation of advancing of the chuck 13 and the cosmetics stick 4 will be defined. Another member may substitute for the bend piece 55 to define the advancing extremity of the push spring 17.

The push spring 17 is installed in a compressed state between the lower surface of the partition 47 and the upper surface of the bend piece 55 on the bar 15. The push spring 17 is put in, from the tail (lower) end of the bore 57 of the cartridge cylinder 11, by pushing the spring 17 in with a pipe-like tool having almost the same diameter as the push spring. The chuck 13 and the cosmetics stick 4 are urged toward the retracting direction by the push spring 17, so that when the push rod 23 of the main body 7 retracts, the chuck 13 and the cosmetic material 4 consequently retract. While the push rod 23 is kept feeding out, if the cartridge 5 is taken out from the main body 7, the chuck 13 and cosmetics stick 4 will automatically return to the retracting extremity (fully retracted position shown in FIG. 1A)

The main body 7, according to this embodiment, comprises two main parts, the main cylinder 21 and push rod 23. The main cylinder 21 is a cylindrical-shaped part as a whole and has a cap connecting portion 63 at the outer surface of its upper portion. The cap connecting portion 63 has a smaller diameter than the rest of the main cylinder 21 and has engageable projections 67 thereon. The rear or bottom end 51 of the cartridge cylinder 11 is inserted into the front bore 65 of the main cylinder 21. The front bore 65 is provided with the annular recess 61 at the upper portion thereof. One-piece-formed internally threaded portion 73 inwardly projects on the inner surface at around the middle portion of the main cylinder 21, and the internal thread 75 is formed on the inner surface of the through hole at the center of the internally threaded portion 73. The push rod 23 is housed in a rear bore 81 of the main cylinder 21, which is the inner surface of a rear or bottom portion 79 under the internally threaded portion 73. Since this push rod 23 itself has a structure of non-slipping off, a tail plug is not necessary in the main cylinder 21. A plug, however, may be provided at the lower end of the main cylinder 21 to conceal the inside of the main cylinder 21.

The push rod 23 is provided with synchronously engageable ribs 71 at the outer circumference of the tip portion thereof, having a little larger diameter than the diameter of the main portion of push rod 23. Said synchronously engageable ribs 71 will be engaged, in a non-rotatable manner and axially slidably, with the synchronously engageable grooves 59 of the bore 57 at the lower part of the cartridge cylinder 11, when the cartridge 5 is attached to the main body 7, so that the push rod 23 and cartridge 11 will be synchronously engaged with each other so as to be non-rotatable relative to each other. The lower surface of the synchronously engageable ribs 71 are abutted against the upper surface of the internally threaded portion 73 of the main cylinder 21 to define the retracting extremity of the push rod. A group of projections 77 are formed on the outer circumference of the push rod 23, except at the front (top) end and rear (lower) end. Said projections 77 are arranged, at a predetermined pitch, in four rows with an angle of 90 between the rows on the outer circumference of push rod 23, and serve as an external thread to engage with the internal thread 75.

A bend piece 83 is formed on the outer surface of the rear end of the push rod 23 and has the same structure as that of the bend piece 55 of the rear end of the chuck bar 15. Said bend piece 83 will bend inwardly when the push rod 23 passes downwardly through the internally threaded member 73, in the process of mounting the push rod 23 from the top into the main cylinder 21. After the push rod 23 passes through the member 73, the bend piece 83 will return to its normal shape (spring back), due to its own resiliency, and protrude outwardly from the push rod 23 (as shown in FIG. 1A). This bend piece 83 abuts against the lower surface of the internally threaded portion 73 to define the uppermost limit of the push rod 23 when the push rod is advanced.

Operation of the cartridge type feeding container for a cosmetics stick in FIG. 1A is as follows. When the cartridge 5 is inserted in the main body 7, the synchronously engageable ribs 71 of the front (top) end of the push rod 23 will be engaged with the synchronously engageable grooves 59 of the bore 57 at the rear (lower) portion of the cartridge cylinder 11. Rotating the cartridge cylinder 11 and the main cylinder 21 relative to each other will cause the push rod 23 and the main body 21 to rotate relative to each other, and then the push rod 23 advances by the threadably engageable function between the internal thread 75 and the group of projections 77. Consequently, the bar 15 of the chuck 13 is pushed upwardly by the push rod 23, and the chuck 13 and the cosmetics stick 4 advance upwardly in and out from the cartridge cylinder 11. By a reverse rotation of the cartridge cylinder 11 and main cylinder 21, the push rod 23 retracts. The bar 15, chuck 13 and cosmetics stick 4 also retract due to the biasing force of the push spring 17 toward the retracting direction.

One of significant characteristics of the embodiment of FIG. 1A is that however thin the cartridge becomes, the top end of the push rod 23 is always larger than the shape of spiral grooves of the main body thereof, so that the size of the push rod 23 can be made larger. In other words, since the top end of the push rod may be formed with the almost same diameter as that of the cartridge bore (the top of the push rod actually is a bit smaller), a bigger diametered section may be formed at the top portion of the push rod 23 so as to define the retracting end, and at the same time, a bend stopper 83 may be formed at the rear end of the push rod 23 so as to define the advancing end. The main body 7 will, therefore, function with only two main parts.

In a conventional push spring arrangement, as well as in a pull spring arrangement, when a rotation-stop mechanism with the push rod is provided in the cartridge, the diameter of the push rod will automatically be so reduced that the component parts used in the main body will be complicated. Moreover, various problems, such as leaning of a cosmetics stick, or the push rod becoming damaged, have arisen in case of advancing or retracting of a cosmetics stick in the prior art, because it is advanced or retraced by a push rod whose diameter is smaller than that of the rear end of the core chuck.

Other embodiments of the synchronous engagement mechanism of the push rod and the cartridge are described below.

Figure 2A:
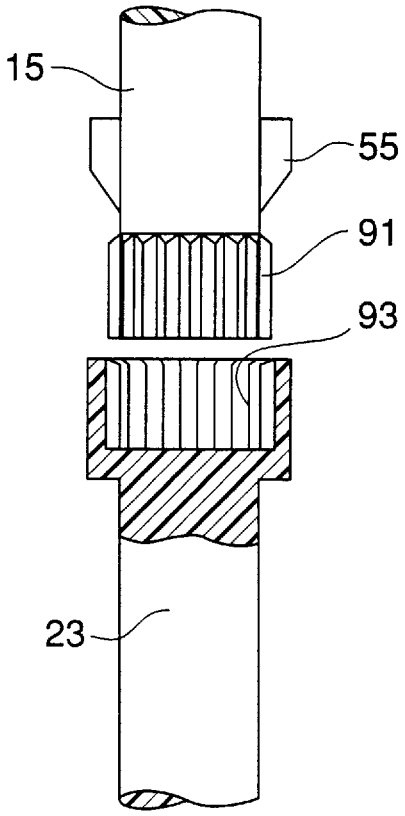
FIGS. 2A and 2B show partially cross-sectional side views of synchronous engagement mechanisms of the push rod and the chuck bar.
Figure 2B:
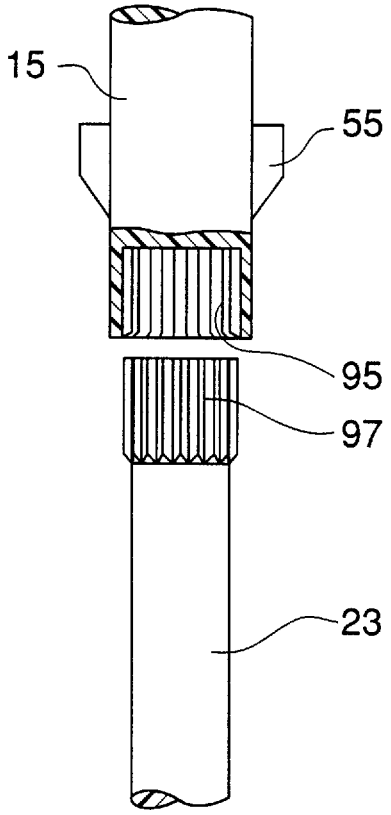

FIGS. 2A and 2B are partially cross-sectional side views of respective synchronous engagement mechanisms between a push rod 23 and chuck bar 15. In these embodiments, a synchronous engagement portion is provided between the chuck and the cartridge cylinder and also between the rear end of the chuck bar and the front end of the push rod. In other words, a rotation-stop mechanism can be provided either in the cartridge or at the outside or inside of the rear or bottom end of the core chuck bar, as long as the push rod and the cartridge cylinder are non-rotatable relative to each other, but are axially slidable when engaged. Accordingly, since almost any shape can be so applied to the rotation-stop mechanism, without considering the width or the diameter of a cosmetic material, it is flexible to deal with any shapes of the cartridge type feeding container for a cosmetics stick.

As shown in FIG. 2A, the push rod 23 has a cavity at the top end portion thereof, synchronously engageable grooves 93 being formed in said cavity. Synchronously engageable ribs 91 are formed on the outer surface of the rear (lower) end of the bar 15. Said synchronously engageable grooves 93 and ribs 91 will be synchronously engaged with each other when the cartridge 5 is inserted in the main body 7. Since the bar 15 is positioned in a non-rotatable manner in the through hole in the partition 73, the push rod 23 and the cartridge cylinder 11 will eventually be synchronously engaged with each other so as to be non-rotatable relative to each other. FIG. 2B is a partially sectional view of an embodiment opposite to that of FIG. 2A. Synchronously engageable ribs 97 are formed on the push rod 23; synchronously engageable grooves 95 are formed in a cavity on the bar 15.

Figure 3:
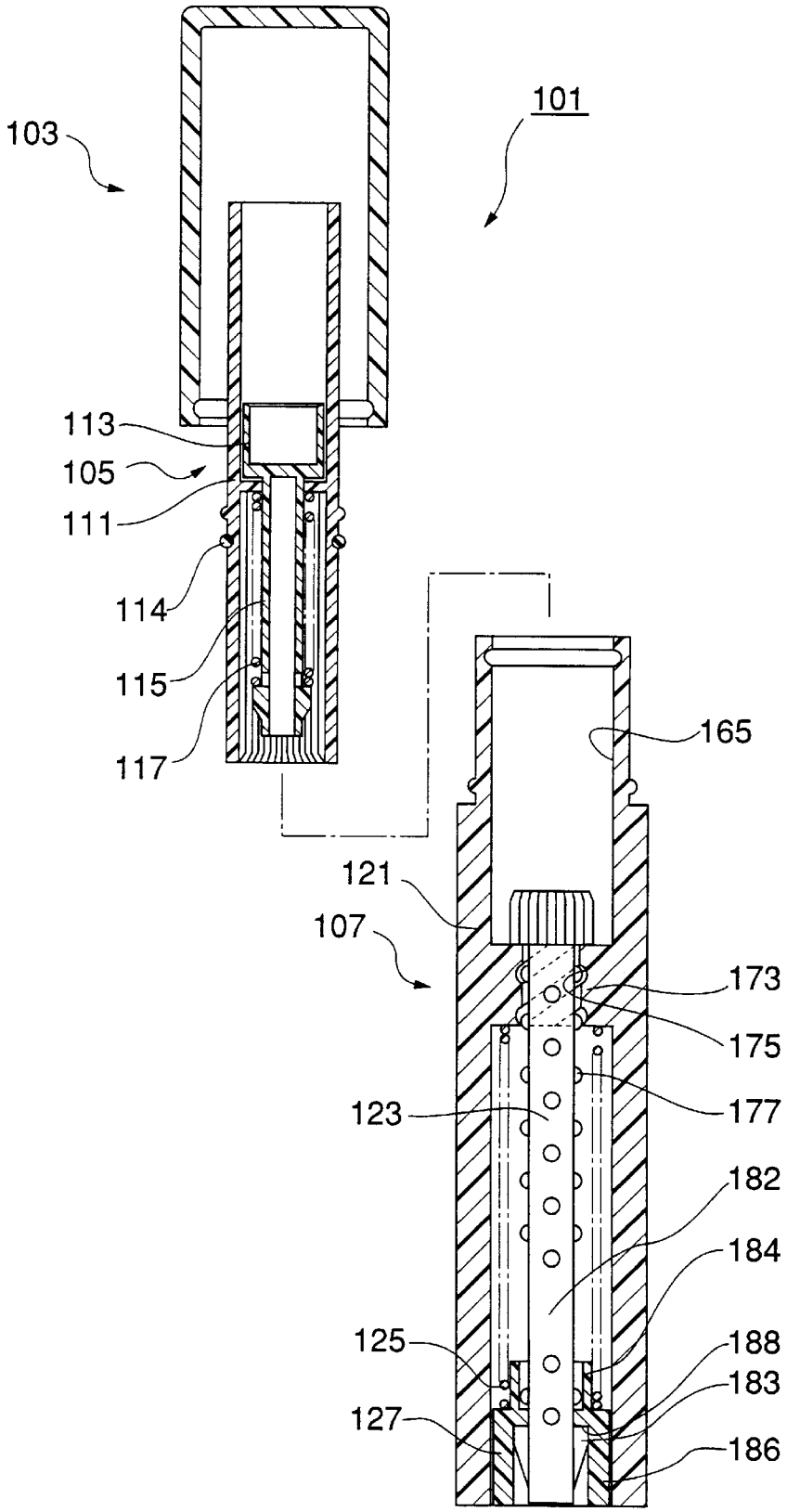
FIG. 3 shows a cross-sectional side view of the inner structure of the cartridge type feeding container for a cosmetics stick according to another embodiment of the present invention.

FIG. 3 shows a cross-sectional view of the inner construction of the cartridge type feeding container for a cosmetics stick. Any reference numeral in FIG. 3 which is the same as in FIG. 1 is incremented by 100 and designates the same part or portion as that in FIG. 1, unless otherwise specified in the following description.

The cartridge type feeding container 101 according to the embodiment of FIG. 3 and the container in FIGS. 1A–1D differ as follows.

1) An O-ring 114 is attached to the outer surface of the cartridge cylinder 111, to provide rotational friction resistance between the cartridge cylinder 111 and main cylinder 121. By the function of a return spring 125 of the main body 107 (to be described later), the O-ring 114 will prevent the cartridge 111 from running idle in the bore 165 at the top end of the main cylinder while the push rod 123 is being advanced.

2) The main body 107 has a spring 125 housed therein for automatic-return of the push rod 123. Said spring 125 is mounted under a compressed state between the lower surface of the internally threaded portion 173 and the upper surface of the sleeve 127 on the outer circumference of the push rod 123. When the push rod 123 becomes freely rotatable while being fed out, the push rod 123 will automatically return to the retracting extremity, rotating. By this mechanism, the push rod 123 will automatically retract to the retracting extremity when the cartridge 105 is removed from the main body 107, while the push rod 123 is being fed out, so that the cosmetics stick will not be adversely fed out the next time when a cartridge 105 is inserted in the main body 107. The sleeve 127, which has a ring shape, hooks on the bend piece 183 at the step portion 188 inside thereof so as not to slip off. The front portion 184 of the sleeve 127 will be engaged with projections and is firmly fixed to the push rod 123.

3) The rear (lower) end of the outer surface of the push rod 123 is a clutch portion 182 having no group of projections 177 thereon. When the push rod 123 is fed out and said clutch portion 182 meets the internal thread 175, the push rod 123 will become running idle. The user thus can feel that the push rod has reached the advancing extremity, and each part of the mechanism can be prevented from damage due to over-feeding by the user.

Figure 4A:
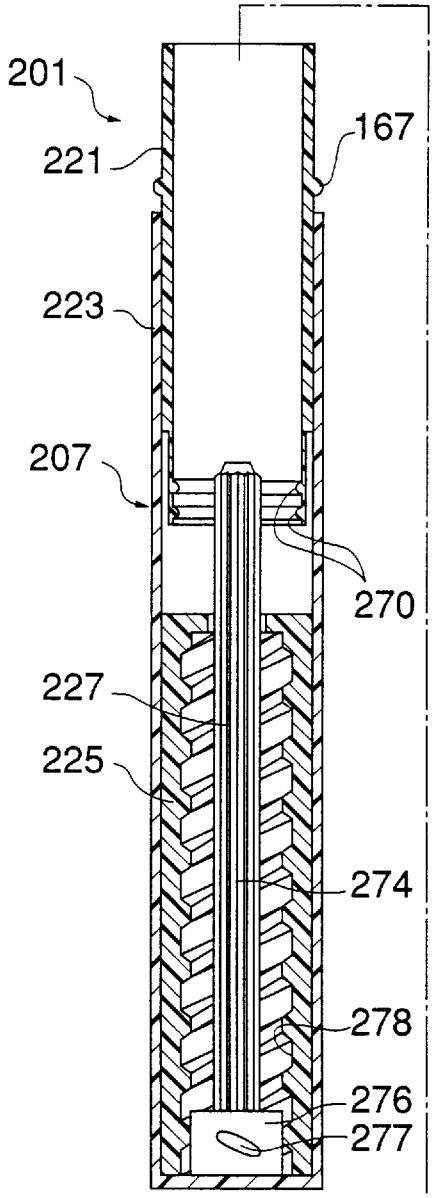
Figure 4B:
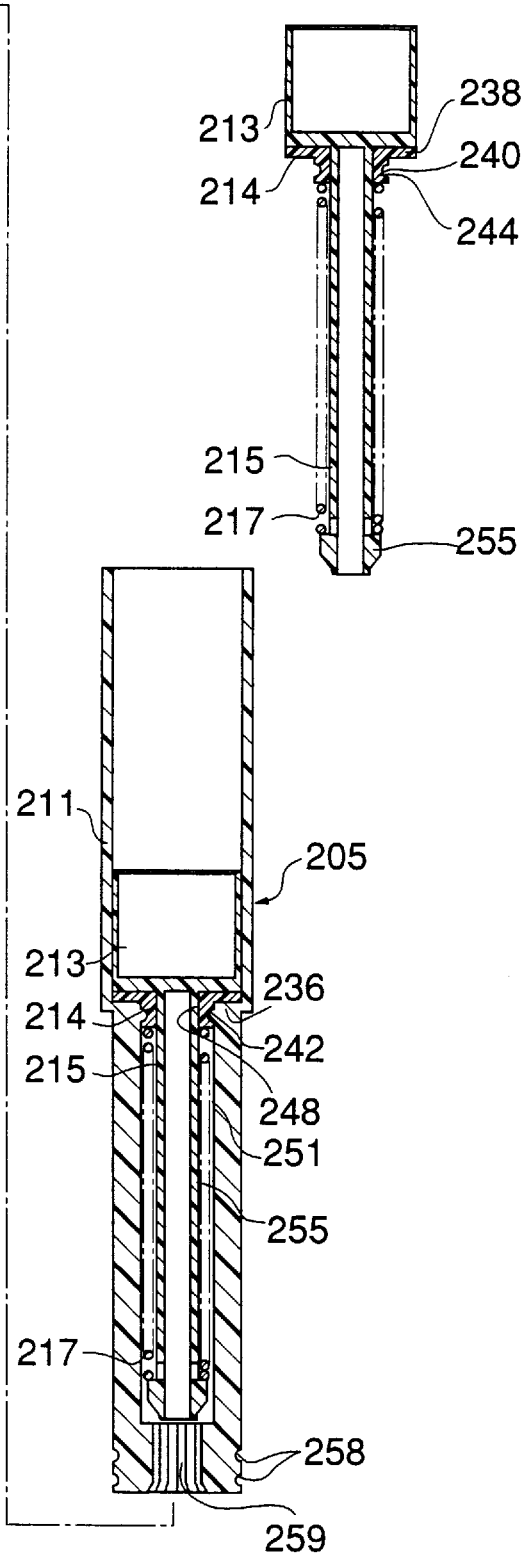

FIGS. 4A and 4B show cross-sectional side views of the inner construction of the cartridge type feeding container for a cosmetics stick according to another embodiment of this invention. FIG. 4A shows the whole container; and FIG. 4B shows an assembly of a chuck, partition member, and push spring.

Any reference numeral in FIG.4 which is the same as in FIGS. 1A–1D is incremented by 200 and designates the same part or portion as that in FIGS. 1A–1D, unless otherwise specified in the following description.

The cartridge type feeding container 201 according to the embodiment of FIGS. 2A and B, and the container in FIGS. 1A–1D, differ as follows.

1) The partition portion of the cartridge 205 is formed as a partition member 214, which is made as another separate partition member. Said separate partition member 214 comprises an upper flanged portion 238 and a pipe-like portion 244 protruding downward from the flanged portion 238. The flanged portion 238 sits on the leveled step portion 236 of the cartridge 211. The pipe-like portion 244 is provided with an engagement recess portion 240 (see FIG. 4B) on the outer circumference thereof. Said recess portion 240 is so engaged with the engagement projection 242 (FIG. 4A), protrudely formed on the inner surface of the cartridge cylinder 211, that the partition member 214 is retained in the cartridge cylinder 211 by a snap-type fit. The bar 215 goes through the hole 248 of the partition member 214, and the upper portion of the push spring 217 abuts the lower surface of the partition member 214. As shown in FIG. 4B, the chuck 213, partition member 214, and push spring 217 can be incorporated together as an assembly unit, which is to be mounted in the cartridge cylinder 211 from the top of the cartridge cylinder 211. The cartridge 205 will be completed by fitting the unit in from the front (top) of the cartridge body. By altering the fitting section between the assembly unit and the cartridge to correspond to the diameter of the cosmetics stick or the length of a feeding-out stroke, the cartridge type feeding container for a cosmetics stick is flexibly or universally applicable to almost any width or diameter of cosmetic materials that can be provided.

2) Synchronously engagement grooves 259 are formed only at the lower end portion of the cartridge cylinder 211, while synchronously engageable ribs 274, which extend substantially along the entire length of the push rod 227, are formed on the outer surface of the push rod 227. Consequently, the push rod 227 can be engaged with the cartridge cylinder at any point on the whole stroke of the push rod 227. Said push rod 227 is provided with a flange 276, which has an externally threaded projection 277 on the outer surface thereof, at the lower end thereof. This externally threaded projection 277 will spirally engage with the internally threaded cylinder 225.

3) The main body 207 comprises of an engagement cylinder 221, the main cylinder 223 made of metal, and an internally threaded cylinder 225 made of synthetic resin (plastics material), and the push rod 227.

When the metal cylinder 223 is used, it is hard to form an annular recess for engaging the cartridge, though the metal-made part improves container's exclusive appearance. In such a case, the engagement cylinder 221 is fixed to the main metal outer cylinder 223, an engagement section 167 is formed on the outer surface of the engagement cylinder 221, and on the inner surface is formed an engagement ridge section 270 which will engage with an annular recess 258 of the cartridge 205.

Figure 5A:
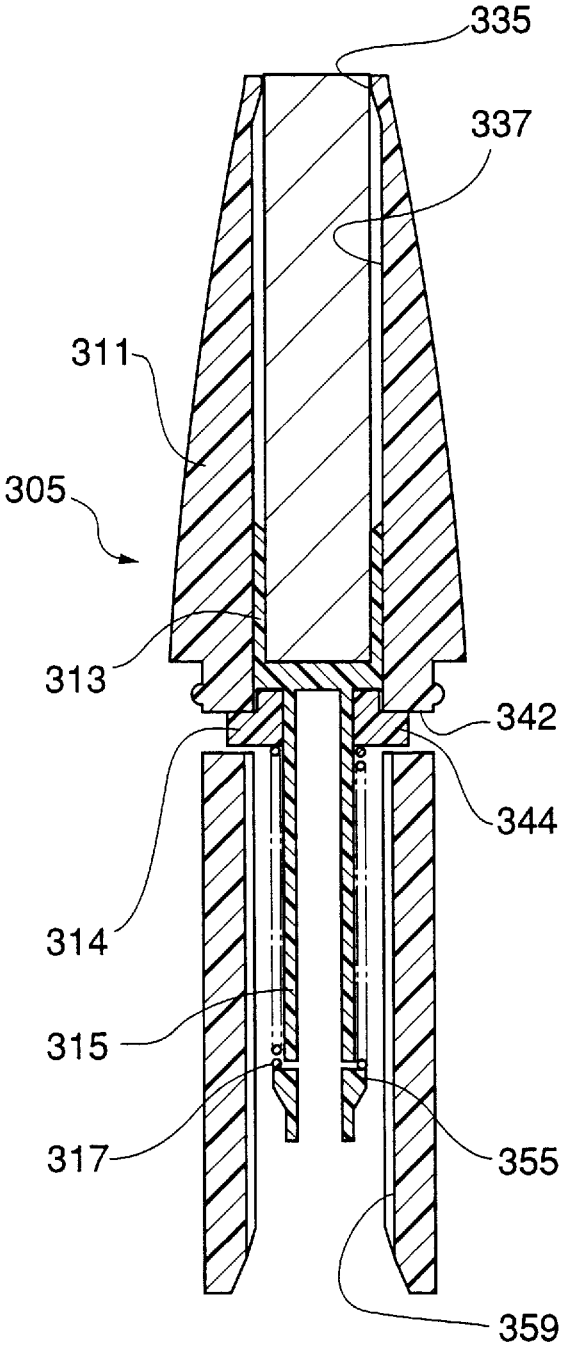
Figure 5B:
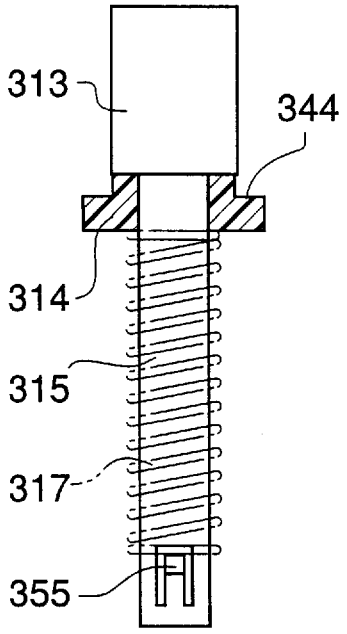

FIGS. 5A and 5B show the cartridge construction of the cartridge type feeding container for a cosmetics stick according to still another embodiment of this invention. FIG. 5A shows a cross-sectional side view of the whole cartridge. FIG. 5B shows a view of an assembly unit of built-in parts. Any reference numeral in FIGS. 5A and 5B which is the same as in FIGS. 1A–1D is incremented by 300 and designates the same part or portion as in FIGS. 1A–1D, unless otherwise specified in the following description.

According to the embodiment of FIGS. 5A and 5B, the top opening 335 of the cartridge 305 is narrower than the bore 337, and the diameter of the chuck 313 is greater than that of the top opening 335.

Projections 344 are formed on the outer circumference of the partition member 314, and windows or openings 342 are provided at the middle level of the cartridge cylinder 311. The projections 344 are so engaged with the windows or openings 342 to define the position of the partition member 314 in the cartridge cylinder 311. An assembled unit of the chuck 313, the partition member 314 and the push spring 317 is inserted into the cartridge cylinder 311 from the bottom. During the insertion, the projections 344 of the partition member 314 proceed inside the synchronously engageable grooves 359. The partition member 314 has a cut on its outer circumference, like a shape of C-ring. Because of this construction, the width of the cut of the partition member 214 shrinks so that the partition member 214 can pass through the synchronously engageable section 359. In this embodiment, the assembled unit of the chuck 313, partition member 314 and push spring 317 is to be inserted in from the rear or bottom end opening of the cartridge.

As shown in FIGS. 4A and 4B, the assembled unit can be inserted selectively in, either from the top end or the rear (bottom) end of the cartridge, and retained in the cartridge, without consideration on the width or size of the diameter of the cosmetics stick in the container. A rotation-stop mechanism applicable to the container may be selected from a variety of rotation-stop mechanisms so that it is possible to flexibly deal with various types of cartridge type feeding containers for a cosmetics stick.

As is evident from the above description, a cartridge type feeding container for a cosmetics stick according to the present invention has the following advantages.

1) The diameter of a container can be reduced, and the number of parts employed therein can also be reduced.

2) According to the embodiments in FIGS. 1A–1D, 3, and 4A–4B, the upper portion of the cartridge, in which a cosmetics stick is charged, may have a circular or oval (or other) shape; in any case, the system is adaptable to a direct charge type, because there are no slits or engagement grooves for the cosmetics stick.

3) According to the embodiment of FIGS. 1A–1D, a cartridge type feeding container for a cosmetics stick is constructed by a total of 5 main parts, three main parts in the cartridge and two main parts in the main body.

4) Since a rotation-stop mechanism inside the cartridge can be provided either on the inside surface of the cartridge body or at the outside of the rear portion of the core chuck bar, a cartridge type feeding container for a cosmetics stick, which is flexibly adaptable to any width or size of the diameter of the core chuck bar, can be provided.

5) For the above reasons, the compatibility between the cartridge and the main body can be freely selected by modifying the method (construction) of the push rod and the rotation-stop mechanism.

6) Employing a pre-assembled unit (chuck, partition member, and push spring), the structures according to the embodiments of FIGS. 4A, 4B and 5A, 5B will easily provide a cartridge which can be easily assembled and which is easily adaptable to a variety of diameters of cosmetics sticks or length of a stroke (of the push rod).

7) In the main body of the cartridge in which a push spring is mounted, as well as a pull spring, the diameter of the push rod is small. Further, in such a case that a rotation-stop mechanism is provided in the cartridge, the diameter of the push rod can be made even smaller, while still providing an apparatus of high structural integrity and convenient size.

The present invention provides the following advantages, since the top end of the push rod may be formed with almost the same diameter as that of the cartridge bore (the push rod is actually a bit smaller), and the diameter of the top end of the push rod may be larger than the internal thread, and the remaining parts of the push rod may be made thick.

1) A main body can be constructed with two main parts, an outer cylinder and a push rod. The top end large diametered section of the push rod may define the retracting extremity, and the rear bending section at the end of the push rod may define the advancing extremity.

2) The diametric clearance between the cartridge and main body may be more reduced.

3) The rear end of the core chuck (chuck bar) in the cartridge is abutted by the surface having a larger diameter than that of rear end of the core chuck; therefore, a cosmetics stick will seldom be caused to lean, and can be firmly advanced and retracted, without considering the size of the core cosmetic material (i.e., the size of the cosmetics stick).

Various modifications and alterations can be made within the scope of the appended claims. Features of one embodiment can be combined with other embodiments, consistent with proper operation. While the principles of the invention have been described above in connection with specific apparatus, it is to be clearly understood that this description is made only by way of example and not as a limitation on the scope of the invention.

I claim:

1. A cartridge type feeding container for a cosmetics stick, comprising:

a main body having a push rod which can be advanced and retracted axially relative to the main body; and a cartridge detachably mounted on an end portion of said main body, and in which a cosmetics stick is to be mounted such that the mounted cosmetics stick is axially slidable in the cartridge;

said push rod and said main body having a spiral engagement mechanism therebetween;

said cartridge having:

a chuck having a holding portion which holds a rear end of a cosmetics stick and which is advanced by said push rod;

a cartridge cylinder which has a bore in which said chuck is slidable; and a push spring coupled to the chuck and which urges the chuck toward the retracting direction;

said chuck further having a chuck bar which extends toward a rear end of said cartridge from said holding portion;

said cartridge cylinder having a partition section which has a through hole through which said bar is inserted; and said push spring being mounted between a rear end of said bar and said partition section;

said cartridge cylinder and said push rod being provided with a synchronously engageable section, in which the cartridge cylinder and the push rod will become engaged non-rotationally with each other when the cartridge is inserted in the main body, thereby allowing the push rod to be advanced or retraced by rotating the cartridge and the main body relative to each other.

2. The cartridge type feeding container according to claim 1, wherein said synchronously engageable section is provided at a front end portion of said push rod and at a rear bore portion of said cartridge cylinder.

3. The cartridge type feeding container according to claim 1, wherein said synchronously engageable section is formed between said chuck bar and said push rod such that the chuck bar is non-rotatable but axially slidable.

4. The cartridge type feeding container according to claim 1, wherein said synchronously engageable section comprises a longitudinal engageable section in the bore of the rear end of the cartridge which has a shape of a push rod, which corresponds to said engageable section and which extends axially along the length of at least a feeding-out stroke.

5. The cartridge type feeding container according to any one of claims 1, 2, 3 or 4, further comprising:

an urging unit for always urging the push rod downward, said urging unit being provided in the main body; and a frictional resistance member provided in the cartridge to prevent idle rotation of the cartridge relative to the main body.

6. The cartridge type feeding container according to any one of claims 1, 2, 3 or 4, further comprising a bend piece, which protrudes outwardly and which bends inwardly when pushed inwardly, the bend piece being arranged at a rear end portion of the bar of said chuck and which engages a push spring.

7. The cartridge type feeding container according claim 5, further comprising a bend piece, which protrudes outwardly and which bends inwardly when pushed inwardly, the bend piece being arranged at a rear end portion of the bar of said chuck and which engages a push spring.

8. The cartridge type feeding container according to any one of claims 1, 2, 3 or 4, wherein:

the partition section, the chuck bar, and the push spring are mounted together as an assembled unit, which assembled unit is insertable from front or rear end openings of the cartridge cylinder; and further comprising an engagement section in said cartridge for engaging said assembled unit such that said assembled unit is fixably retained in said cartridge.

9. The cartridge type feeding container according to claim 5, wherein:

the partition section, the chuck bar, and the push spring are mounted together as an assembled unit, which assembled unit is insertable from front or rear end openings of the cartridge cylinder; and further comprising an engagement section in said cartridge for engaging said assembled unit such that said assembled unit is fixably retained in said cartridge.

10. The cartridge type feeding container according to claim 6, wherein:

the partition section, the chuck bar, and the push spring are mounted together as an assembled unit, which assembled unit is insertable from front or rear end openings of the cartridge cylinder; and further comprising an engagement section in said cartridge for engaging said assembled unit such that said assembled unit is fixably retained in said cartridge.

11. The cartridge type feeding container according to claim 7, wherein:

the partition section, the chuck bar, and the push spring are mounted together as an assembled unit, which assembled unit is insertable from front or rear end openings of the cartridge cylinder; and further comprising an engagement section in said cartridge for engaging said assembled unit such that said assembled unit is fixably retained in said cartridge.

* * * * *

UNITED STATES PATENT AND TRADEMARK OFFICE

CERTIFICATE OF CORRECTION

PATENT NO. : 5,884,638

DATED : March 23, 1998

INVENTOR(S) : Atsushi OHBA

It is certified that error appears in the above-identified patent and that said Letters Patent is hereby corrected as shown below:

In the Title page,

Item [56] References Cited, under "FOREIGN PATENT DOCUMENT"

"4567 of 1887" to --4567 12/1887--.

Signed and Sealed this

Twenty-eighth Day of March, 2000

*Attest:*

*Attesting Officer*

Q. TODD DICKINSON

*Commissioner of Patents and Trademarks*

UNITED STATES PATENT AND TRADEMARK OFFICE

CERTIFICATE OF CORRECTION

PATENT NO. : 5,884,638

DATED : March 23, 1999

INVENTOR(S) : Atsushi OHBA

It is certified that error appears in the above-identified patent and that said Letters Patent is hereby corrected as shown below:

On the Title page,

Item [73] Assignee, change "Suzono" to --Suzuno--.

Signed and Sealed this

Thirty-first Day of October, 2000

*Attest:*

*Attesting Officer*

Q. TODD DICKINSON

*Director of Patents and Trademarks*